United States Patent [19]

Ito

[11] Patent Number: 4,864,349

[45] Date of Patent: Sep. 5, 1989

[54] DEVELOPING APPARATUS

[75] Inventor: Kouji Ito, Osaka, Japan

[73] Assignee: Minolta Camera Kabushiki Kaisha, Japan

[21] Appl. No.: 214,647

[22] Filed: Jul. 1, 1988

[30] Foreign Application Priority Data

Jul. 2, 1987 [JP] Japan ..... 62-167578

[51] Int. Cl.[4] ..... G03G 15/08; G03G 15/09

[52] U.S. Cl. ..... 355/253; 118/653

[58] Field of Search ..... 355/30 D, 14 D; 118/653, 651–658

[56] References Cited

U.S. PATENT DOCUMENTS 3,664,299 5/1972 Shaler et al. ..... 118/657 X 4,708,458 11/1987 Ueda et al. ..... 355/3 DD

*Primary Examiner*—A. T. Grimley

*Assistant Examiner*—J. Pendegrass

*Attorney, Agent, or Firm*—Wenderoth, Lind & Ponack

[57] ABSTRACT

A developing apparatus in which first to third transport passages are provided at the back of a developing section and developing material exceeding transport capacity of the first transport passage is fed to the second transport passage, while the excessive developing material which can not be transported to the first transport passage is transported to the third transport passage where variation of the amount of the developing material is adjusted.

4 Claims, 3 Drawing Sheets

DEVELOPING APPARATUS

BACKGROUND OF THE INVENTION

The present invention generally relates to a developing apparatus for use in a copying apparatus, printer or the like, based on an electrophotographic copying process, and more particularly, to a developing apparatus arranged to use part of a two or dual-component developing material composed of toner and carrier for developing, while such developing material is transported through circulation.

Conventionally, as a developing apparatus of the above described type, there has been proposed, for example, an arrangement as shown in FIG. 4.

The known developing apparatus 101 in FIG. 4 includes a casing 102, and a developing section 104 formed at a front portion of said casing 102, and having a developing sleeve 105 incorporated therein with a magnet roller (not shown) and disposed to confront a photosensitive surface 100a of a photosensitive or photoreceptor drum 100 as shown. At the rear side of the developing section 104, there are formed a first transport passage 113 and a second transport passage 114 partitioned by a partition wall 107 and communicated with each other through a first path 109 and a second path 111 respectively formed at an inner side and an outer side of the partition wall 107, with first and second screw members 116 and 117 being rotatably provided within the transport passages 113 and 114 respectively.

In the conventional developing apparatus 101 having the construction as described above, the two or dual component developing material composed of toner and carrier is accommodated, and the developing material in the second transport passage 114 is transported in a direction indicated by an arrow X4 based on the rotation of the second screw member 117, and is further transported into the first transport passage 113 along the direction of an arrow X5 through the path 109 at the inner side end portion. Meanwhile, the developing material in the first transport passage 113 is transported in a direction indicated by an arrow Xl based on the rotation of the first screw member 116, and is transported into the second transport passage 114 in a direction of an arrow X3 through the path 111 at the outer side end portion, with part of the developing material being supplied onto the surface of the developing sleeve 105 as the developing material is transported through the transport passage 113. The developing material thus fed onto the developing sleeve 105 is transported in a direction indicated by an arrow X2 based on the rotation of the developing sleeve 105 so as to be led to a developing region P where the developing sleeve 105 confronts the photosensitive surface **100*a* of the photoreceptor drum 100, and supplies toner to an electrostatic latent image formed on the surface 100*a* of the drum 100** for the formation of a visible toner image.

On the other hand, in the developing apparatus 101, in order to stably supply the developing material larger than a predetermined amount to the developing section 104 at all times, it is so arranged to make the transport capacity of the developing material by the second screw member 117 larger than that by the first screw member 116, and also to make a cut-out width of the first path 109 larger than that of the second path 111, thereby to maintain the developing material in the first transport passage 113 at a high level.

However, in the prior art developing apparatus 101 as described above, since there is provided no means for adjusting the amount of the developing material to be transported into the first transport passage 113 through the first path 109, the amount of the developing material transported through the first transport passage 113 is directly affected by the reduction of the developing material.

Therefore, when the whole amount of the developing material is reduced as the carrier is gradually decreased as well as the toner through repeated developing functions effected, or when the amount of the developing material is temporarily varied by the toner replenished through the second transport passage 114, its influence directly appears in the amount of the developing material transported to the developing region P, thus resulting in deterioration of image quality due to smearing or fogging, etc. of the copied images.

SUMMARY OF THE INVENTION

Accordingly, an essential object of the present invention is to provide an improved developing apparatus in which the amount of developing material to be supplied to a developing region is maintained constant for providing stable image quality, with substantial elimination of disadvantages inherent in the conventional developing apparatuses of this kind.

Another object of the present invention is to provide a developing apparatus of the above described type which is simple in construction and stable in functioning, and can be readily incorporated into copying apparatuses and the like at low cost.

In accomplishing these and other objects, according to one preferred embodiment of the present invention, there is provided a developing apparatus for use in an electrophotographic copying process, which comprises a developing section, first, second and third transport passages sequentially provided at a rear side of said developing section, a first partition wall provided between said first and second transport passages, a second partition wall provided between said second and third passages, first and second paths for respectively communicating said first and second transport passages at inner and outer sides of said first partition wall, third and fourth paths for respectively communicating said second and third transport passages at inner and outer sides of said second partition wall, first and third transport means respectively provided in said first and third transport passages for transporting developing material in each of said first and third transport passages from the inner side towards the outer side, and a second transport means provided in said second transport passage for transporting the developing material from the outer side towards the inner side, with transporting capacity of said second transport means being adapted to be larger than that of said first transport means, and a cross sectional area of said first path for passing the developing material therethrough being arranged to be larger than that of each of the second path and third path.

By the above arrangement according to the present invention, an improved developing apparatus has been advantageously presented through simple construction.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
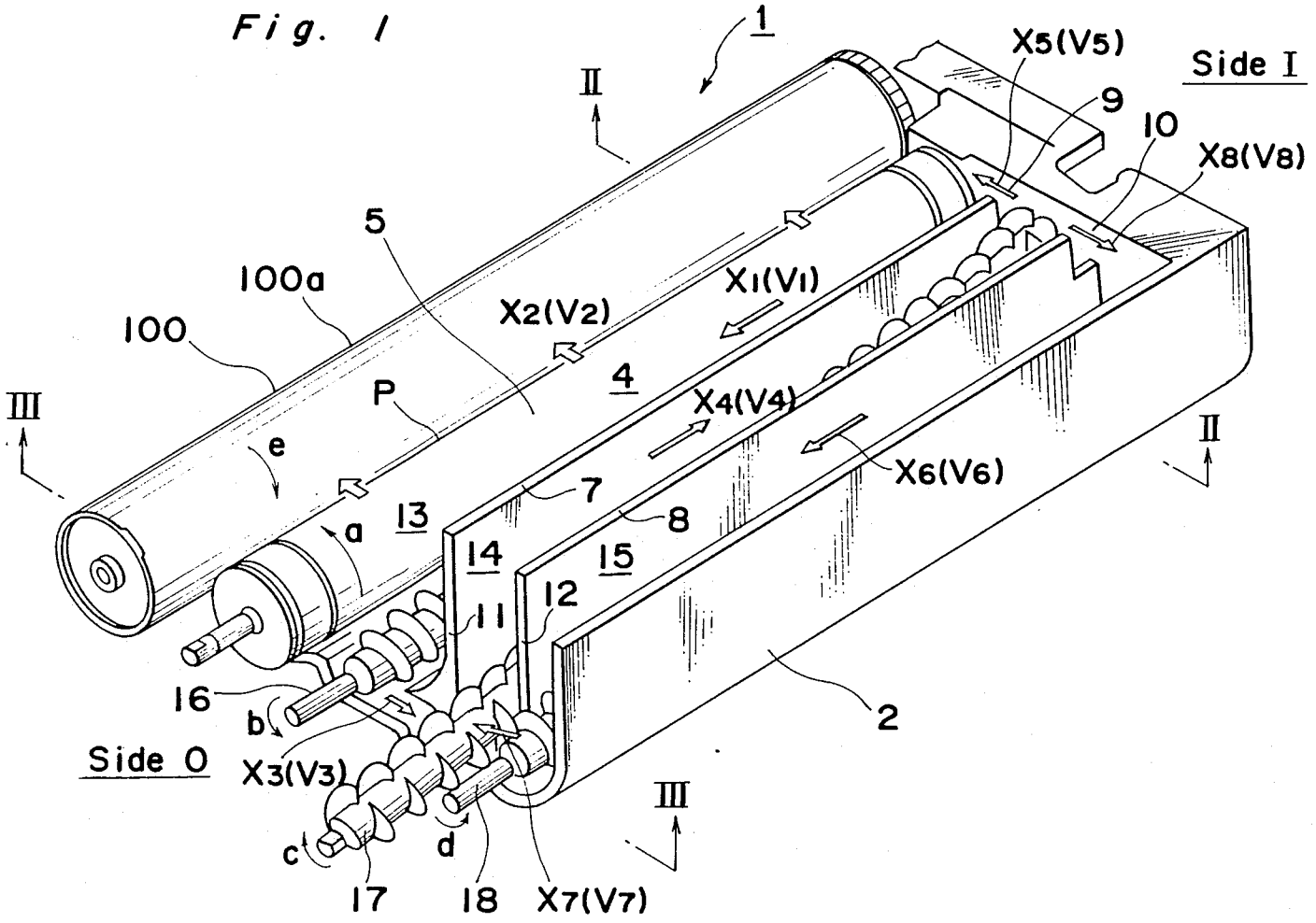
FIG. 1 is a perspective view showing general construction of a developing apparatus according to one preferred embodiment of the present invention, with a cover plate thereof removed for clarity.

Before the description of the present invention proceeds, it is to be noted that like parts are designated by like reference numerals throughout the accompanying drawings.

Figure 2:
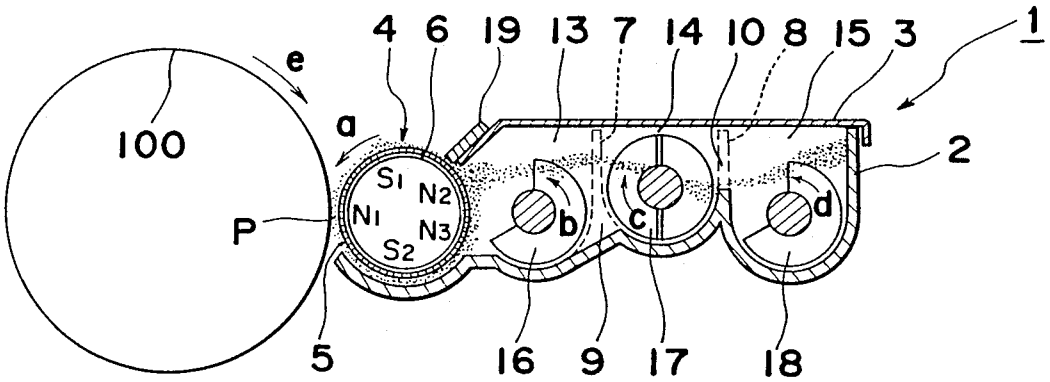
FIG. 2 is a cross-section taken along the line II—II in FIG. 1, a cover plate applied thereon.
Figure 3:
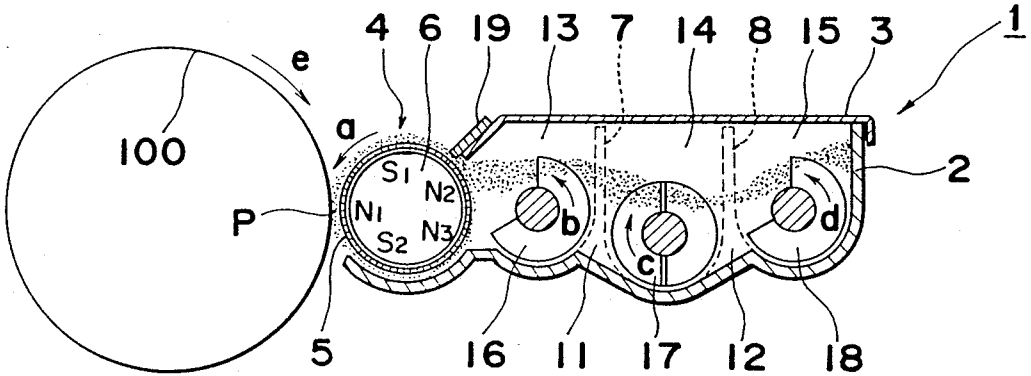
FIG. 3 is also a cross-section taken along the line III—III in FIG. 1, with a cover plate applied thereon.
Figure 4:
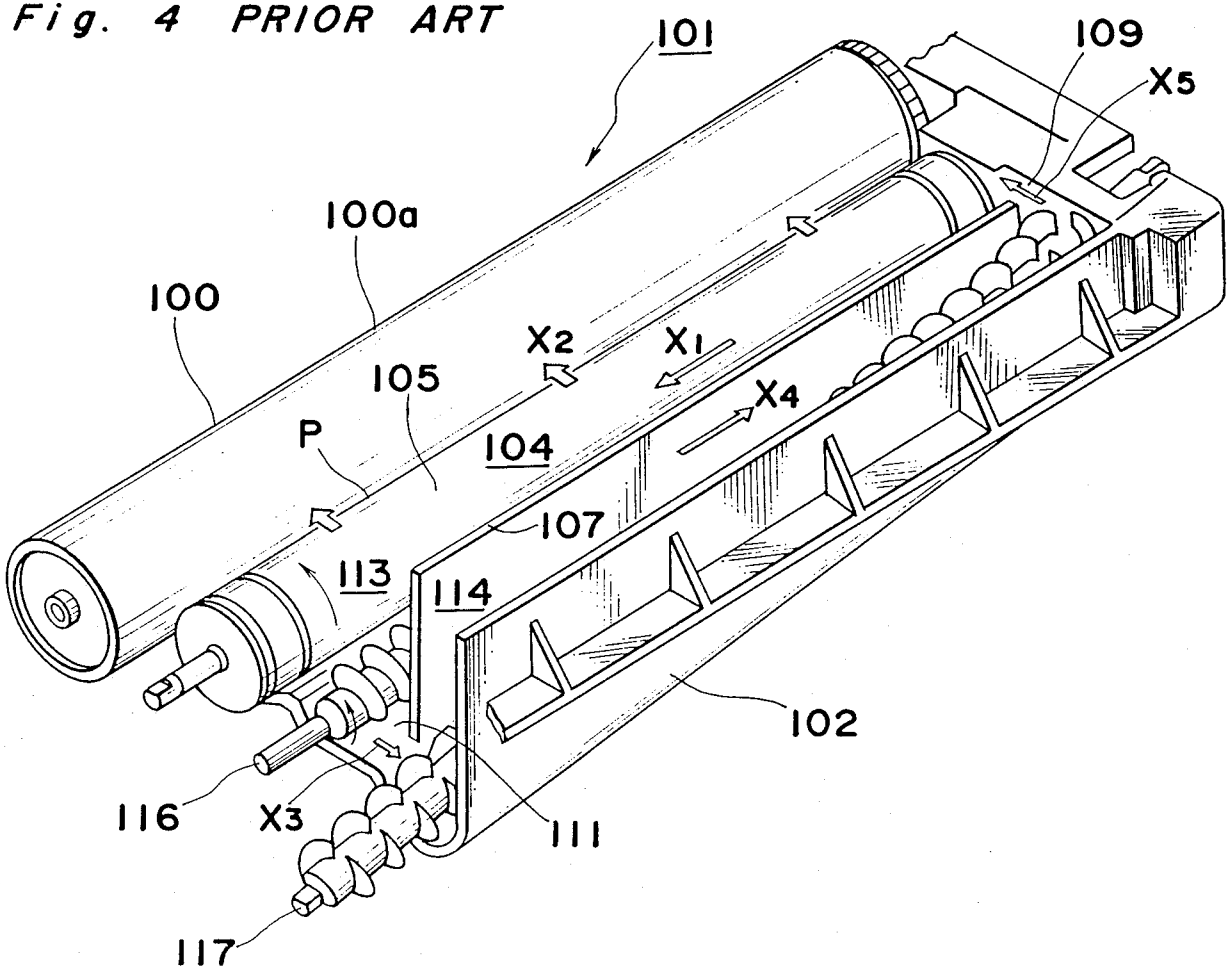
Fig. 4 PRIOR ART
FIG. 4 is a perspective view similar to FIG. 1, which particularly shows a conventional developing apparatus (already referred to).

Referring now to the drawings, there is shown in FIG. 1 a developing apparatus 1 according to one preferred embodiment of the present invention. The developing apparatus 1 generally includes a housing constituted by a casing 2 and a cover plate 3 (FIGS. 2 and 3) applied thereon, and a developing section 4 provided at a front portion of the casing 2.

In the developing section 4, there is provided a developing sleeve 5 so as to be driven for rotation in a direction indicated by an arrow a, and within the developing sleeve 5, a magnet roller 6 (FIGS. 2 and 3) including a plurality of magnets having magnetic poles N1 to N3 and S1 and S2 extending in its axial direction is fixedly accommodated.

At the back of the developing section 4, a first partition wall 7 and a second partition wall 8 are formed to extend upwardly from the bottom of the casing 2 so as to partition the rear portion of the housing, thereby sequentially forming first, second and third transport passages 13, 14 and 15 rearwardly. It is to be noted here that the bottom portions of the first and third transport passages 13 and 15 are adapted to be parallel with the axis of the developing sleeve 5, while the bottom portion of the second transport passage 14 is inclined so as to be lower than the bottom portions of the first and third transport passage 13 and 15 at an outer side O of the developing apparatus 1, and to be higher than the bottom portions of said passages 13 and 15 at an inner side I of the apparatus 1. The end portions of the first partition wall 7 at the inner and outer sides I and O are respectively cut out to form first and second paths 9 and 11, while the end portions of the second partition wall 8 at the inner and outer sides I and O are similarly cut out to form third and fourth paths 10 and 12 respectively.

In the first, second and third transport passages 13, 14 and 5, there are respectively provided first, second and third screw members 16, 17 and 18 so as to be driven for rotation in directions indicated by arrows b, c and d for transporting the developing material accommodated in the transport passages 13, 14 and 15 in directions shown by arrows X1, X4 and X6. Meanwhile, fresh toner newly replenished into the developing apparatus 1 is supplied to a replenishing path (not shown) formed at the outer side of the second transport passage 14, and transported into the second transport passage 14 by the second screw 17.

In the developing apparatus 1 having the construction as described above, the two or dual-component developing material composed of toner and carrier is accommodated, and circulated for transportation in the manner as described hereinbelow.

The developing material within the third transport passage 15 is transported by the third screw member 18 along the direction of the arrow X6 from the inner side I towards the outer side O so as to be fed into the inner side of the second transport passage 14 through the fourth path 12.

The developing material within the second transport passage 14 is transported by the second screw member 17 along the direction of the arrow X4 from the outer side O towards the inner side I, and fed into the first and third transport passages 13 and 15 through the first path 9 and third path 10 respectively.

The developing material within the first transport passage 13 is transported by the first screw member 16 along the direction of the arrow X1 from the inner side I towards the outer side O, and fed to the second transport passage 14 through the second path 11 at the outer side, and during the transportation through the first transport passage 13, part of the developing material is supplied onto the surface of the developing sleeve 5.

The developing material thus supplied onto the surface of the developing sleeve 5 is transported in a state of magnetic brush in the direction indicated by the arrow X2 based on the rotation of the developing sleeve 5, while being restricted by the bristle height restricting member 19 (FIGS. 2 and 3) attached to the front portion of the cover plate 3 in a spaced relation from the surface of said developing sleeve 5, and develops the electrostatic latent image formed on the photosensitive surface 100*a* of the photoreceptor drum 100 into a visible toner image at a developing region P confronting the drum 100 rotated in the direction indicated by an arrow e.

The developing material passing through the developing region P is transported in the direction of the arrow a based on the rotation of the developing sleeve 5, and upon arrival at the portion where the magnetic poles N3 and N2 of the same polarity are located to be adjacent to each other, separated from the surface of the developing sleeve 5 so as to be mixed into the developing material transported through the first transport passage 13.

Subsequently, the amount of the developing material transported through the transport passages 13, 14 and 15 will be described.

The transport amount V1 of the developing material by the first screw member 16 is equal to the amount V5 of the developing material passing through the first path 9, and becomes the sum of the amount V3 of the developing material transported into the second transport passage 14 through the second path 11 and the amount V2 of toner (including the amount of carrier lost) consumed by the developing.

$$V1max > V1 = V5 = V2 + V3$$

where V1max is the transporting capacity of the first screw member 16.

The transport amount V4 of the developing material by the second screw member 17 is the total sum of the amounts V3 and V7 of the developing material introduced from the first and third transport passages 13 and 15, and the amount ΔV of toner to be newly replenished into the second transport passage 14, and also, becomes the sum of the amounts V5 and V8 of the developing material flowing through the first and third paths 9 and 10.

$$V4max > V4 = V3 - V7 - \Delta V = V5 - V8$$

where V4max is the transporting capacity of the second screw member 17.

Meanwhile, the amount V6 of the developing material by the third screw member 18 is equal to the flowing-in amount V8 from the third path 10 and the flowing-out amount V7 from the fourth path 12.

$$V6=V8=V7$$

In the developing apparatus 1 according to the present invention in which the developing material is transported through respective transport passages 13 to 15, it is so arranged that the transporting capacity V4max of the second screw member 17 is larger than the transporting capacity V1max of the first screw member 16, while the cross sectional area of the first path 9 through which the developing material passes is set to be larger than that of the second path 11 or the third path 10. Particularly, the bottom of the third path 10 (i.e., the bottom face of the cut-out portion) is located approximately at the central portion of the second screw member 17 as show in FIG. 2, whereas other paths 9, 11 and 12 are cut out up to approximately the bottom face of the transport path.

Moreover, the sum of the transporting capacity V1max of the first screw member 16 and the transporting capacity V6max of the third screw member 18 is set to be smaller than the transporting capacity V4max of the second screw member 17.

$$V4max > V1max + V6max$$

Accordingly, in the state where a sufficient amount of developing material is accommodated in the first transport passage 13, and the transporting capacity V1max of the first screw member 16 is approximately equal to the actual transport amount V1, the amount V5 of the developing material transported into the first transport passage 13 through the first path 9 becomes generally constant, and in the amount V4 of he developing material transported through the second transport passage 14, the amount V8 which is not introduced into the first transport passage 13 is carried into the third transport passage 15 through the third path 10.

Thus, even when the amount of the whole developing material in the developing apparatus 1 is reduced, since the transporting capacity V4max of the second screw member 17 is set to be larger than the transporting capacity V1max of the first screw member 16, the developing material approximately equal to that as described earlier is introduced into the first transport passage 13 through the first path 9. On the other hand, the amount of the developing material transported into the third transport passage 15 through the third path 10 is decreased, and the variation in amount of the developing material appears as the variation in amount of the developing material in the third path 10.

Meanwhile, even when toner is replenished into the second transport passage 14, the variation in amount of the developing material in the second transport passage 14 following the replenishment becomes the variation in amount of the developing material transported into the third transport passage 15 through the third path 10, and thus, the amount of the developing material transported into the first transport passage 13 through the first path 9 is maintained approximately at a constant value.

In other words, the third transport passage 15 functions to maintain the amount of the developing material within the first transport passage 13 generally constant, in the similar manner as in a sub-tank for maintaining an amount of a cooling liquid within a radiator constant at all times in a cooling apparatus for a motor vehicle.

Therefore, the amount V1 of the developing material transported through the first transport passage 13 is maintained constant even when the developing material is reduced or toner is replenished, and the amount V2 of the developing material transported to the developing region P through the developing sleeve 5 is made constant.

Accordingly, toner is stably supplied at all times with respect to the electrostatic latent image formed on the photosensitive surface 100*a* of the photoreceptor drum 100, thereby stabilizing the quality of the images to be developed by the developing apparatus 1.

As is clear from the foregoing description, in the developing apparatus according to the present invention, the first to third transport passages are provided at the back of the developing section and the developing material exceeding the transporting capacity of the first transport passage is fed to the second transport passage, while the excessive developing material which can not be transported to the first transport passage is transported to the third transport passage so as to adjust the variation of the amount of the developing material thereat.

Accordingly, even when the amount of the developing material is reduced following consumption of the carrier or it is temporarily varied following replenishment of toner, the amount of variation is adjusted at said third transport passage, whereby the amount of the developing material in the first transport passage is maintained to be generally constant. Therefore, the amount of the developing material transported to the developing region is held constant so as to provide a stable image quality.

Furthermore, since the developing apparatus of the present invention is arranged to extend rearwardly, more developing material and carrier can be accommodated therein as compared with a developing apparatus having the bulky configuration similar to the conventional apparatuses, and thus, it becomes possible to arrange the copying apparatuses, etc. to deal with multicolor copying by disposing many developing units containing toner in different colors around the photoreceptor drum, while durability of the developing material may be prolonged by lengthening the replenishing cycle of the carrier.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A developing apparatus for use in an electrophotographic copying process, which comprises a developing section, first, second and third transport passages sequentially provided at a rear side of said developing section, a first partition wall provided between said first and second transport passages, a second partition wall provided between said second and third passages, first and second paths for respectively communicating said first and second transport passages at inner and outer sides of said first partition wall, third and fourth paths for respectively communicating said second and third transport passages at inner and outer sides of said second partition wall, first and third transport means respectively provided in said first and third transport passages for transporting developing material in each of said first and third transport passages from the inner side towards the outer side, and a second transport means provided in said second transport passage for transporting the developing material from the outer side towards the inner side, transporting capacity of said second transport means being adapted to be larger than that of said first transport means, and a cross sectional area of said first path for passing the developing material therethrough being arranged to be larger than that of each of the second path and third path.

2. A developing apparatus as claimed in claim 1, wherein the bottom portion of said second transport passage has an inclination so as to be lower than bottom portions of said first and third transport passages at an outer side of the developing apparatus, and also to be higher than bottom portions of said first and third transport passages at an inner side of said developing apparatus.

3. A developing apparatus as claimed in claim 1, wherein said first, second and third transport means are screw members rotatably provided in said first, second and third transport passages respectively.

4. A developing apparatus as claimed in claim 1, wherein the sum of transporting capacities of said first transport means and said third transport means is set to be smaller than the transporting capacity of said second transport means.

* * * * *